US010546543B2

(12) United States Patent
Chen

(10) Patent No.: US 10,546,543 B2
(45) Date of Patent: Jan. 28, 2020

(54) LIQUID CRYSTAL DISPLAY DEVICE AND METHOD FOR DRIVING THE SAME

(71) Applicants: HKC Corporation Limited, Shenzhen (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 19 days.

(21) Appl. No.: 15/743,954

(22) PCT Filed: May 22, 2017

(86) PCT No.: PCT/CN2017/085349
§ 371 (c)(1),
(2) Date: Jan. 11, 2018

(87) PCT Pub. No.: WO2018/120609
PCT Pub. Date: Jul. 5, 2018

(65) Prior Publication Data

US 2018/0374428 A1 Dec. 27, 2018

(30) Foreign Application Priority Data

Dec. 27, 2016 (CN) ..... 201611228633

(51) Int. Cl.
*G09G 3/36* (2006.01)
*G09G 3/34* (2006.01)

(52) U.S. Cl.
CPC ..... *G09G 3/342* (2013.01); *G09G 3/3413* (2013.01); *G09G 3/3607* (2013.01);
(Continued)

(58) Field of Classification Search
CPC ..... G09G 3/3614; G09G 2320/028; G09G 2320/0252; G09G 3/36; G09G 3/3607;
(Continued)

(56) References Cited

U.S. PATENT DOCUMENTS 8,487,949 B2 * 7/2013 Morimoto ..... G09G 3/3406 345/102
2004/0104877 A1 * 6/2004 Kitagawa ..... G09G 3/3406 345/88
(Continued)

FOREIGN PATENT DOCUMENTS

CN 101513036 A 8/2009
CN 101866636 10/2010
(Continued)

OTHER PUBLICATIONS

International Search Report and Written Opinion of the International Searching Authority, dated Oct. 10, 2017, from International Application No. PCT/CN2017/085349, filed on May 22, 2017. 12 pages.

*Primary Examiner* — Duc Q Dinh
(74) *Attorney, Agent, or Firm* — HoustonHogle LLP

(57) ABSTRACT

A method for driving an LCD device includes displaying each picture with two frame images sequentially; driving voltages for two adjacent sub-pixels in each of the frame images are different, and driving voltages for each sub-pixel in the first frame image and the second frame image are different; determining backlight brightness regulation signals for each of the backlight subareas; the backlight brightness regulation signals are grouped signals, the number of the groups is identical to the number of types of the color sub-pixels; calculating an average color chroma of a current picture region corresponding to each of the backlight subareas; determining whether the average color chroma of each of the backlight subareas is within a preset range; if yes,
(Continued)

performing a brightness regulation to a backlight source of the backlight subarea in each of the frame images of a next picture according to the backlight brightness regulation signal of the backlight subarea.

18 Claims, 7 Drawing Sheets

(52) U.S. Cl.
CPC ..... *G09G 2320/029* (2013.01); *G09G 2320/0242* (2013.01); *G09G 2320/0626* (2013.01); *G09G 2360/16* (2013.01)

(58) Field of Classification Search
CPC ..... G09G 3/3659; G09G 2320/0626; G09G 2320/0666; G09G 2320/068; G09G 2340/06; G09G 3/2074; G09G 2300/0443; G09G 2320/0242; G09G 2360/16; G09G 3/3413; G09G 2320/0646; G09G 3/342; G09G 2320/0247; G09G 3/3406; G09G 2320/062; G09G 3/3426; G09G 2320/0285; G09G 2320/029; G02F 2001/134345; G02F 2001/134354; G02F 1/136259; G02F 1/133603
USPC ..... 345/102
See application file for complete search history.

(56) References Cited

U.S. PATENT DOCUMENTS

| | | | | |
|---|---|---|---|---|
| 2007/0247391 | A1* | 10/2007 | Someya | G09G 3/3406 345/7 |
| 2008/0117162 | A1 | 5/2008 | Song et al. | |
| 2009/0015720 | A1* | 1/2009 | Yamamoto | G09G 3/3406 348/607 |
| 2010/0149224 | A1* | 6/2010 | Baba | G09G 3/3413 345/690 |
| 2011/0012937 | A1 | 1/2011 | Onishi et al. | |
| 2011/0148940 | A1* | 6/2011 | Byun | G09G 3/3413 345/690 |
| 2014/0043376 | A1* | 2/2014 | Zhang | G09G 3/3607 345/690 |

FOREIGN PATENT DOCUMENTS

| | | |
|---|---|---|
| CN | 102138098 | 7/2011 |
| CN | 104615395 A | 5/2015 |
| CN | 105355181 A | 2/2016 |
| CN | 105355182 | 2/2016 |
| CN | 106057134 A | 10/2016 |

* cited by examiner

LIQUID CRYSTAL DISPLAY DEVICE AND METHOD FOR DRIVING THE SAME

CROSS REFERENCE TO RELATED APPLICATION

This application is a § 371 National Phase Application of International Application No. PCT/CN2017/085349, filed on May. 22, 2017, which claims priority to Chinese Patent Application No. 201611228633.3, entitled "LIQUID CRYSTAL DISPLAY DEVICE AND METHOD FOR DRIVING THE SAME" filed on Dec. 27, 2016, the contents of which are expressly incorporated by reference herein in their entirety.

FIELD OF THE INVENTION

The present disclosure relates to a liquid crystal display (LCD) technology field, and particularly relates to an LCD device and a method for driving the same.

BACKGROUND OF THE INVENTION

Most conventional large size LCDs adopt negative Vertical Alignment (VA) liquid crystal display or In-plane Switching (IPS) liquid crystal display technology. As to the driving of a VA LCD, in a large viewing angle, the brightness is rapidly saturated with the driving voltage, such that the viewing angle color shift is serious and the quality of the image is affected.

SUMMARY OF THE INVENTION

According to various embodiments of the present disclosure, an LCD device and a method for driving the same are provided, which can address the deficiency of viewing angle color cast.

A method for driving an LCD device includes:

displaying each picture with two frame images sequentially; the two frame images include a first frame image and a second frame image; driving voltages for two adjacent sub-pixels in each of the frame images are different;

determining backlight brightness regulation signals for each backlight subarea according to driving voltages of a first frame image area and a second frame image area, the first frame image area and the second frame image are corresponding to each of the backlight subareas; the backlight brightness regulation signals are grouped signals, the number of the groups is identical to the number of types of the color sub-pixels;

calculating an average color chroma of a current picture region corresponding to each of the backlight subareas;

determining whether the average color chroma of each of the backlight subareas is within a preset range;

if the average color chroma of each of the backlight subareas is within a preset range, performing a brightness regulation to a backlight source of the backlight subarea in each of the frame images of a next picture according to the backlight brightness regulation signal of the backlight subarea.

In an embodiment, the driving voltages for each sub-pixel in the first frame image and the second frame image are found and acquired utilizing a Look-up table (LUT) according to an input signal of each picture.

In an embodiment, further included is a step of pre-storing the LUT.

In an embodiment, the step of determining backlight brightness regulation signals for each of the backlight subareas according to driving voltages of a first frame image area and a second frame image area, with the first frame image area and the second frame image corresponding to each of the backlight subareas, includes: calculating average driving voltages for various color sub-pixels in the first frame image area and the second frame image area, with the first frame image area and the second frame image corresponding to each of the backlight subareas; and calculating a backlight brightness regulation signal according to the average driving voltage, a reference backlight brightness signal and a reference driving voltage.

In an embodiment, in the step of calculating a backlight brightness regulation signal according to the average driving voltage, a reference backlight brightness signal and a reference driving voltage, the formulas to calculate the backlight brightness regulation signal of each color sub-pixel in each of the backlight subareas are:

$$A_{M_P1}*P_{M_ave1}=A_{M_P2}*P_{M_ave2};$$

$$2*A_{M_P}*P_{M_ave}=A_{M_P1}*P_{M_ave1}+A_{M_P2}*P_{M_ave2};$$

P is a target color sub-pixel; M is a serial number of the backlight subarea, $A_{M_P1}$ is the backlight brightness regulation signal to perform the backlight brightness regulation to the backlight source of a P sub-pixel in a backlight subarea M corresponding to the first frame image of the next picture; $A_{M_P2}$ is the backlight brightness regulation signal to perform a backlight brightness regulation to the backlight source of the P sub-pixel in the backlight subarea M corresponding to the second frame image of the next picture; $P_{M_ave1}$ is an average value of the driving voltage of the P sub-pixel in the backlight subarea M corresponding to the first frame image of the current picture; $P_{M_ave2}$ is an average value of the driving voltage of the P sub-pixel in the backlight subarea M corresponding to the second frame image of the current picture; $A_{M_P}$ is the reference backlight brightness signal of the P sub-pixel in the backlight subarea M corresponding to the image of the current picture; $P_{M_ave}$ is the average value of the reference driving voltage of the P sub-pixel in the frame image area corresponding to the backlight subarea M on the image of the current picture.

In an embodiment, in the step of determining whether the average color chroma of each of the backlight subareas is within a preset range, if the average color chroma is not within the preset range, a brightness regulation will not be performed to the backlight source of the backlight subarea.

In an embodiment, the step of performing a brightness regulation to a backlight source of the backlight subarea in each of the frame images of a next picture according to the backlight brightness regulation signal of the backlight subarea includes: calculating an average display hue of a current picture region corresponding to the backlight subarea; determining a backlight regulation object according to the hue range where the average display hue belongs; the backlight regulation object includes a backlight source of at least one of a red sub-pixel, a green sub-pixel and a blue sub-pixel; and performing an independent brightness regulation to the backlight regulation object according to the backlight brightness regulation signal corresponding to the backlight regulation object.

In an embodiment, in the step of determining a backlight regulation object according to the hue range where the average display hue belongs, when the average display hue is $0°<H\leq 45°$ or $315°<H\leq 360°$, the object of the backlight regulation is the backlight source corresponding to the red sub-pixel; when the average display hue is 45°<H≤135°, the object of the backlight regulation are the backlight sources respectively corresponding to the red sub-pixel and the green sub-pixel; when the average display hue is 135°<H≤205°, the object of the backlight regulation is the backlight source corresponding to the green sub-pixel; when the average display hue is 205°<H≤245°, the object of the backlight regulation are the backlight sources respectively corresponding to the green sub-pixel and the blue sub-pixel; when the average display hue is 245°<H≤295°, the object of the backlight regulation is the backlight source corresponding to the blue sub-pixel; and when the average display hue is 295°<H≤315°, the object of the backlight regulation are the backlight sources respectively corresponding to the blue sub-pixel and the red sub-pixel; H is the average display hue.

An LCD device includes: a display panel; a backlight module configured to provide backlight to the display panel; the backlight module is divided into a plurality of backlight subareas; a driving element connected to the display panel and configured to display each picture with two frame images sequentially; the two frame images include a first frame image and a second frame image; driving voltages for two adjacent sub-pixels in each of the frame images are different, and driving voltages for each sub-pixel in the first frame image and the second frame image are different; a backlight control element connected to the driving element, including one or more processors; and memory storing instructions, which, when executed by the one or more processors cause the one or more processors to perform operations including: determining backlight brightness regulation signals for each of the backlight subareas according to driving voltages of a first frame image area and a second frame image area, the first frame image area and the second frame image are corresponding to each of the backlight subareas; the backlight brightness regulation signals are grouped signals, and the number of the groups is identical to the number of types of the color sub-pixels; and calculating an average color chroma of a current picture region corresponding to each of the backlight subareas, and determining whether the average color chroma of each of the backlight subareas is within a preset range; and a backlight regulation element connected to the backlight control element and the backlight module respectively; the backlight regulation element is configured to perform a brightness regulation to a backlight source of the backlight subarea in each of the frame images of a next picture according to the backlight brightness regulation signal of the backlight subarea when the average color chroma of the backlight subarea is determined by the backlight control element to be in the preset range.

In an embodiment, further included is a storage element configured to store an LUT; the LUT is a correspondence table on input signals and the driving voltages for each sub-pixel in the first frame image and the second frame image, the first frame image area and the second frame image are corresponding to the input signals; the driving element acquires the driving voltages for each sub-pixel of the first frame image and the second frame image by looking up in the LUT.

In an embodiment, the one or more processors further execute the instructions to provide steps in following units: a statistic unit configured to calculate average driving voltages for various color sub-pixels in the first frame image area and the second frame image area, the first frame image area and the second frame image are corresponding to each of the backlight subareas; and a calculation unit configured to calculate a backlight brightness regulation signal according to the average driving voltage, a reference backlight brightness signal and a reference driving voltage of each of the backlight subareas.

In an embodiment, the formulas to calculate the backlight brightness regulation signal of each color sub-pixel in each of the backlight subareas are:

$$A_{M_P1}*P_{M_ave1}=A_{M_P2}*P_{M_ave2};$$

$$2*A_{M_P}*P_{M_ave}=A_{M_P1}*P_{M_ave1}+A_{M_P2}*P_{M_ave2};$$

P is a target color sub-pixel; M is a serial number of the backlight area; $A_{M_P1}$ is a backlight brightness regulation signal to perform a backlight brightness regulation to a backlight source of a P sub-pixel in a backlight area M corresponding to the first frame image of the next picture; $A_{M_P2}$ is a backlight brightness regulation signal to perform a backlight brightness regulation to a backlight source of the P sub-pixel in the backlight area M corresponding to the second frame image of the next picture; $P_{M_ave1}$ is an average value of a driving voltage of the P sub-pixel in the backlight area M corresponding to the first frame image of the current picture; $P_{M_ave2}$ is an average value of the driving voltage of the P sub-pixel in the backlight area M corresponding to the second frame image of the current picture; $A_{M_P}$ is a reference backlight brightness signal of the P sub-pixel in the backlight area M corresponding to the image of the current picture; $P_{M_ave}$ is an average value of a reference driving voltage of the P sub-pixel in the frame image area corresponding to the backlight area M on the image of the current picture.

In an embodiment, the one or more processors further execute the instructions to provide a step of controlling the backlight regulation element not to perform a backlight regulation to the backlight source in the backlight subarea when the average color chroma of the backlight subarea is determined by the one or more processors to be out of the preset range.

In an embodiment, the one or more processors further execute the instructions to provide a step of calculating the average display hue of the current picture region corresponding to the backlight and determining the backlight regulation object according to the range where the average display hue belongs when the average color chroma is determined by the at least processor to be within the preset range; the backlight regulation object includes a backlight source of at least one of a red sub-pixel, a green sub-pixel and a blue sub-pixel; the backlight regulation element is further configured to perform an independent brightness regulation to the backlight regulation object according to the backlight regulation signal corresponding to the backlight regulation object.

In an embodiment, the one or more processors further execute the instructions to provide steps of: determining the object of the backlight regulation to be the backlight source corresponding to the red sub-pixel when the average display hue is 0°<H≤45° or 315°<H≤360°; determining the object of the backlight regulation to be the backlight sources respectively corresponding to the red sub-pixel and the green sub-pixel when the average display hue is 45°<H≤135°; determining the object of the backlight regulation to be the backlight source corresponding to the green sub-pixel when the average display hue is 135°<H≤205°; determining the object of the backlight regulation to be the backlight sources respectively corresponding to the green sub-pixel and the blue sub-pixel when the average display hue is 205°<H≤245°; determining the object of the backlight regulation to be the backlight source corresponding to the blue sub-pixel when the average display hue is 245°<H≤295°; and determining the object of the backlight regulation to be the backlight sources respectively corresponding to the blue sub-pixel and the red sub-pixel when the average display hue is 295°<H≤315°; and H is the average display hue.

In an embodiment, the backlight source is a white backlight source, an RGB backlight source, an RGBW backlight source or an RGBY backlight source.

An LCD device includes: a display panel; a backlight module configured to provide backlight to the display panel; the backlight module is divided into a plurality of backlight subareas; a driving element connected to the display panel and configured to display each picture with two frame images sequentially; the two frame images include a first frame image and a second frame image; driving voltages for two adjacent sub-pixels in each of the frame images are different, and driving voltages for each sub-pixel in the first frame image and the second frame image are different; a backlight control element connected to the driving element, including one or more processors; and memory storing instructions, which, when executed by the one or more processors cause the one or more processors to perform operations including: determining backlight brightness regulation signals for each of the backlight subareas according to driving voltages of a first frame image area and a second frame image area that are corresponding to each of the backlight subareas; the backlight brightness regulation signals are grouped signals, and the number of the groups is identical to the number of types of the color sub-pixels; and calculating an average color chroma of a current picture region corresponding to each of the backlight subareas, and determining whether the average color chroma of each of the backlight subareas is within a preset range; and a backlight regulation element connected to the backlight control element and the backlight module respectively; the backlight regulation element is configured to perform a brightness regulation to a backlight source of the backlight subarea in each of the frame images of a next picture according to the backlight brightness regulation signal of the backlight subarea when the average color chroma of the backlight subarea is determined by the backlight control element to be in the preset range; the one or more processors further execute the instructions to perform operations in following units: a statistic unit configured to calculate average driving voltages for various color sub-pixels in the first frame image area and the second frame image area that are corresponding to each of the backlight subareas; and a calculation unit configured to calculate a backlight brightness regulation signal according to the average driving voltage, a reference backlight brightness signal and a reference driving voltage of each of the backlight subareas, the calculation formulas are as follows:

$$A_{M_P1}*P_{M_ave1}=A_{M_P2}*P_{M_ave2};$$

$$2*A_{M_P}*P_{M_ave}=A_{M_P1}*P_{M_ave1}+A_{M_P2}*P_{M_ave2};$$

P is a target color sub-pixel; M is a serial number of the backlight subarea, $A_{M_P1}$ is a backlight brightness regulation signal to perform a backlight brightness regulation to a backlight source of a P sub-pixel in a backlight subarea M corresponding to the first frame image of the next picture; $A_{M_P2}$ is a backlight brightness regulation signal to perform a backlight brightness regulation to a backlight source of the P sub-pixel in the backlight subarea M corresponding to the second frame image of the next picture; $P_{M_ave1}$ is an average value of a driving voltage of the P sub-pixel in the backlight subarea M corresponding to the first frame image of the current picture; $P_{M_ave2}$ is an average value of the driving voltage of the P sub-pixel in the backlight subarea M corresponding to the second frame image of the current picture; $A_{M_P}$ is a reference backlight brightness signal of the P sub-pixel in the backlight subarea M corresponding to the image of the current picture; $P_{M_ave}$ is an average value of a reference driving voltage of the P sub-pixel in the frame image area corresponding to the backlight subarea M on the image of the current picture.

In an embodiment, the one or more processors further execute the instructions to provide a step of calculating the average display hue of the current picture region corresponding to the backlight and determining the backlight regulation object according to the range where the average display hue belongs when the average color chroma is determined by the at least processor to be within the preset range; the backlight regulation object includes a backlight source of at least one of a red sub-pixel, a green sub-pixel and a blue sub-pixel; the backlight regulation element is further configured to perform an independent brightness regulation to the backlight regulation object according to the backlight regulation signal corresponding to the backlight regulation object.

The above LCD driving method, by displaying each picture with two frame images sequentially, each of the frame images is driven by alternate high and low voltage signals, and the high and low driving voltages of the first frame image and second frame image are reverted, and the backlight brightness regulation signals of the next picture are generated in accordance to each driving voltage. Meanwhile, average color chroma of the present picture region corresponding to each of the backlight subareas is calculated and a backlight regulation is merely performed to the backlight source in the backlight subarea corresponding to each of the frame images of the next picture when the average color chroma is determined to be within the preset range, such that the uncomfortable blink notable to the eyes and due to high and low driving voltage switch difference can be reduced, and the blink visible to the eyes and possibly caused by the frequent enabling of backlight source regulation can be avoided, thereby effectively ameliorating the color shift defect of the LCD in large view refraction mismatch.

BRIEF DESCRIPTION OF THE DRAWINGS

The above objects, features and advantages of the present disclosure will become more apparent by describing in detail embodiments thereof with reference to the accompanying drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION OF THE EMBODIMENTS

The present disclosure will be described in the following with reference to the accompanying drawings and the embodiments in order to make the above objects, features and advantages of the present disclosure become more apparent, the specific embodiments will be described in detail in combination with the accompanying drawings. Numerous specific details are described hereinafter in order to facilitate a thorough understanding of the present disclosure. The various embodiments of the disclosure may, however, be embodied in many different forms and should not be construed as limited to the specific embodiments set forth hereinafter, and people skilled in the art can make similar modifications without departing from the spirit of the present disclosure.

Figure 1:
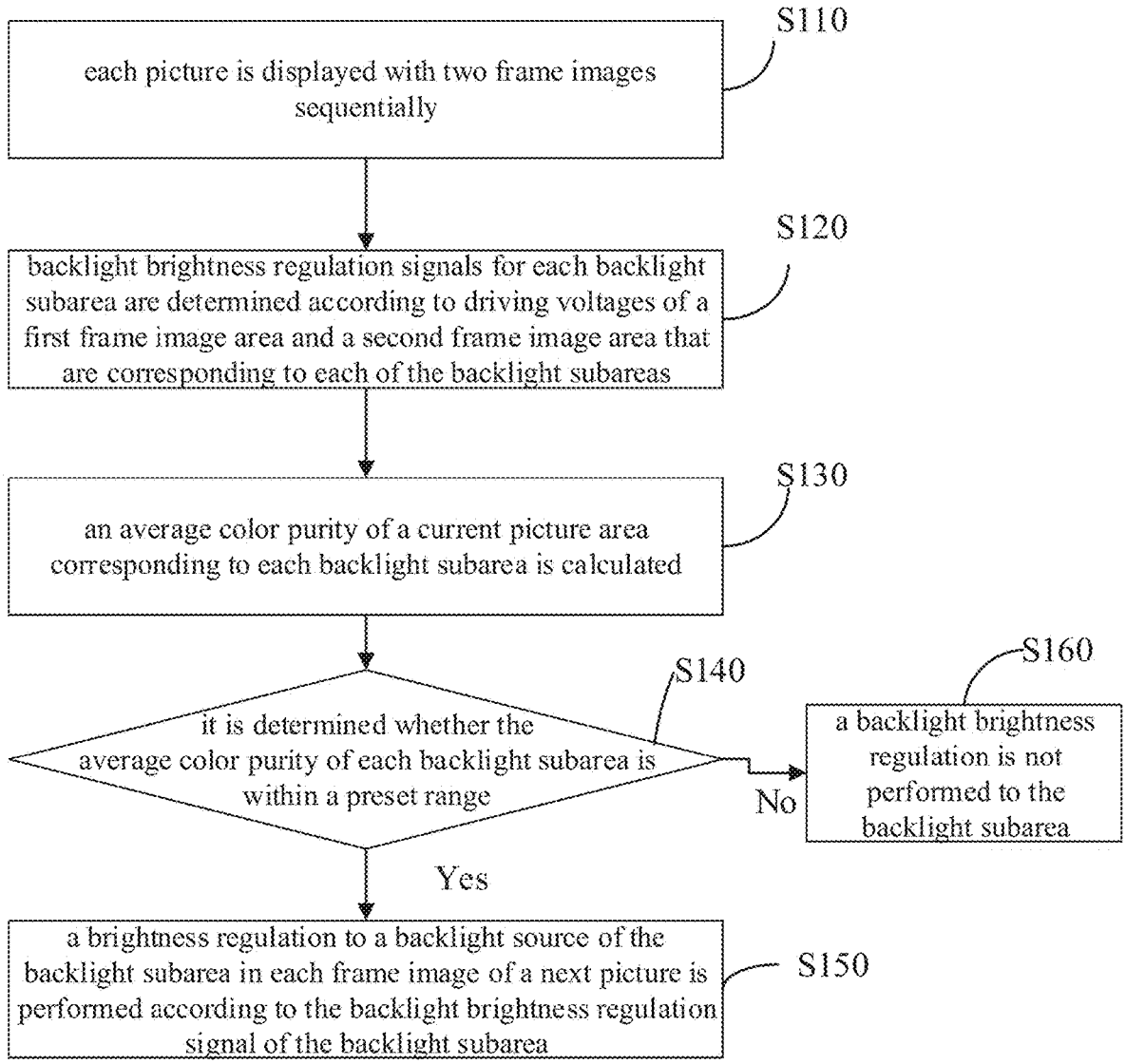
FIG. 1 is a flowchart of a method for driving an LCD device according to an embodiment.
Figure 2:
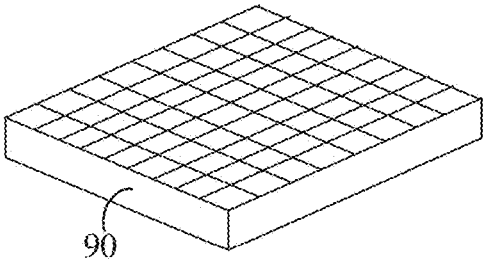
FIG. 2 is a schematic view of partitioning a backlight area of the LCD device in FIG. 1.

FIG. 1 is a flowchart of a method for driving an LCD device according to an embodiment. The LCD device can be a Twisted Nematic (TN), an Optically Compensated Bend (OCB), a Vertical Alignment (VA) or a curved surface device but not limited thereto. The backlight of the CLD may apply direct-lit backlight, the backlight source can be a white light source, an RGB three color light source, an RGBW four color light source or an RGBY four color light source, but not limited thereto. In the present embodiment, the backlight area of the LCD is divided into a plurality of backlight subareas as illustrated in FIG. 2. In FIG. 2, 90 represents the backlight module (or backlight module).

Referring to FIG. 1, the method includes the following steps:

Step S110, each picture is displayed with two frame images sequentially.

Figure 3:
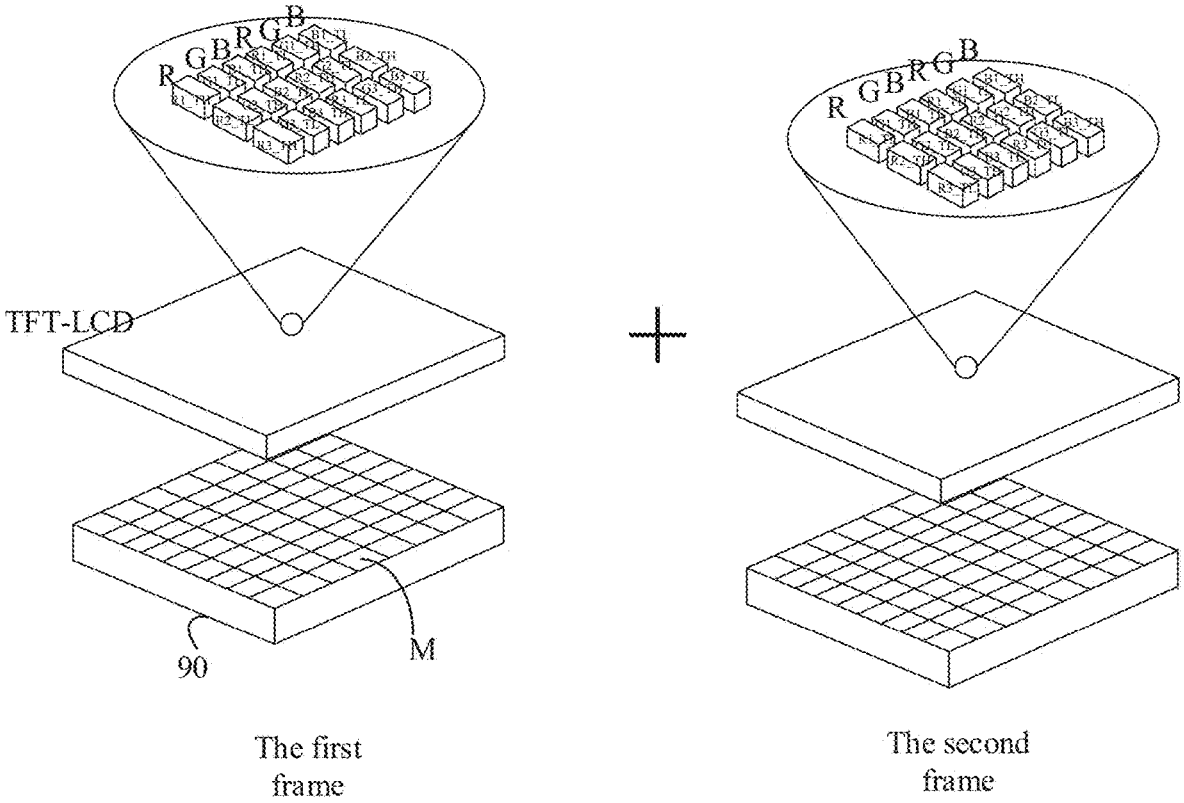
FIG. 3 is a schematic view of driving a display area of the LCD device in FIG. 1.
Figure 4:
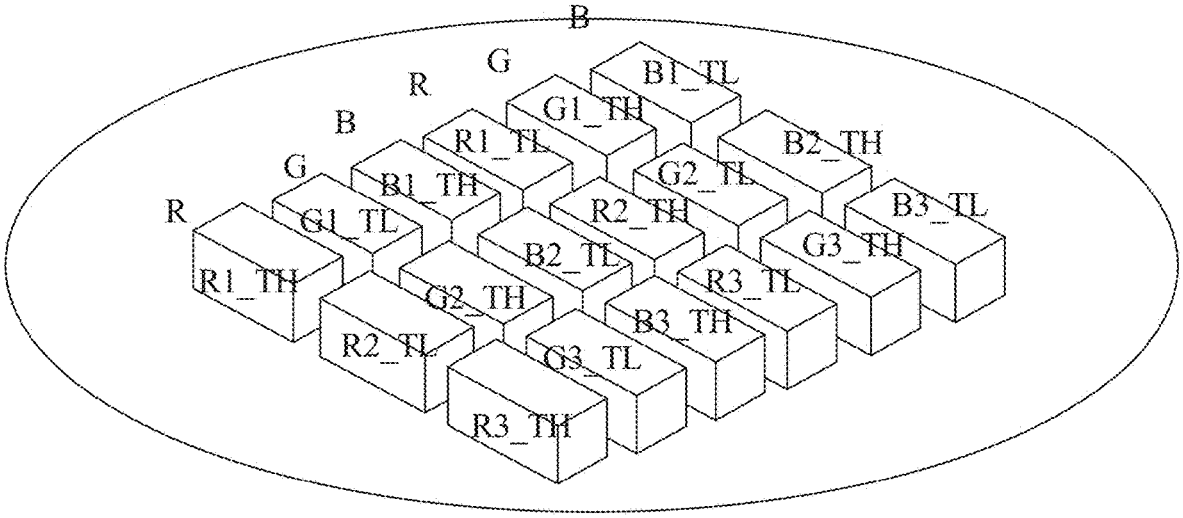
FIGS. 4 and 5 are enlarged views of FIG. 3.
Figure 5:
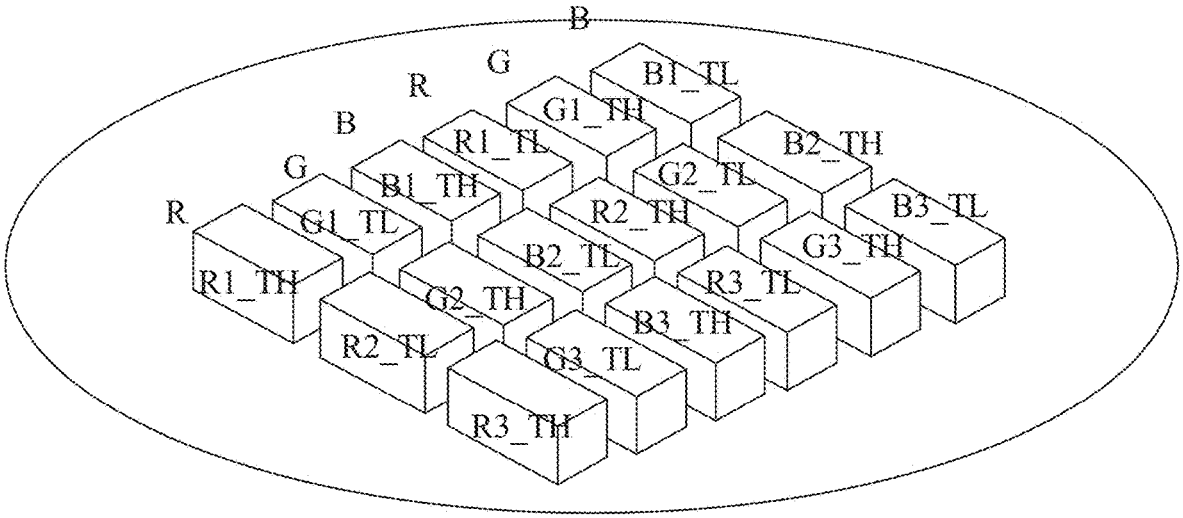

Each picture (i.e., the conventional one frame picture) is displayed with two frame images sequentially, i.e., a picture is divided into two frame images in timing sequence. Through a division to the picture in timing sequence, a frequency doubling can be effected to the frame frequency, i.e., doubling the original 60 Hz to 120 Hz. The two frame images are respectively a first frame image (frame_N−1) and a second frame image (frame_N−2). Through a mutual compensation between the first frame image and the second frame image, an picture corresponding to the input signal is displayed for a user. In the present embodiment, driving voltages for two adjacent sub-pixels in each of the frame images are different, and driving voltages for each of the sub-pixels in the first frame image and the second frame image are different; i.e., the driving voltage for each sub-pixel of the first frame image is reverted to be the driving voltage for each sub-pixel in the second fame image. The driving voltages for each of the sub-pixels in the first frame image and the second frame image can be found and acquired utilizing a Look-up table (LUT). In particular, in the LCD device, the LUT will be pre-stored in the hardware frame buffer. The LUT is a correspondence table on the picture input signals and the driving voltages for each of the sub-pixels in the first frame image and the second frame image that are corresponding to the input signals. In the case of a driving signal of 8 bit, corresponding to each R/G/B input signal input color gray scale value 0~255, there are 256 pairs of high and low voltage signals $R_{TH}/G_{TH}/B_{TH}$ and 3*256 pairs of high and low voltage signals $R_{TL}/G_{TL}/B_{TL}$ in total. Therefore, according to the gray scale value of each sub-pixel in the input signal, corresponding high driving voltage and corresponding low driving voltage can be found, thereby providing the high driving voltage as the driving voltage for the corresponding sub-pixel in the first frame image and the low driving voltage as the driving voltage for the corresponding sub-pixel in the second frame image, or providing the low driving voltage as the driving voltage for the corresponding sub-pixel in the first frame image and the high driving voltage as the driving voltage for the corresponding sub-pixel in the second frame image, while the two adjacent sub-pixels employ a driving method for being alternately driven by a high and a low driving voltage as shown in FIG. 3. FIG. 4 is an enlarged view of a part of the first frame in FIG. 3, and FIG. 5 is an enlarged view of a part of the second frame in FIG. 3.

Step S120, backlight brightness regulation signals for each backlight subarea are determined according to driving voltages of a first frame image area and a second frame image area that are corresponding to each of the backlight subareas.

The backlight brightness regulation signal is used for backlight brightness regulation to the backlight brightness of the two frame images of the next picture to reduce the viewing angle color cast. The backlight brightness regulation signals are grouped signals ($A_{M_P1}$ and $A_{M_P2}$, P is the target color sub-pixel) to respectively regulate the backlight brightness of the backlight subareas corresponding to the first frame image and the second frame image. And the groups of backlight brightness regulation signals and the types of color sub-pixels are identical in number, so as to perform an independent backlight brightness control to various color sub-pixels. For instance, in the present embodiment, color sub-pixels include red sub-pixels (R sub-pixels), green sub-pixels (G sub-pixels) and blue sub-pixels (B sub-pixels), therefore each group of backlight brightness regulation signals includes an R sub-pixel backlight brightness regulation signal group, a G sub-pixel backlight brightness regulation signal group, and a B sub-pixel backlight brightness regulation signal group to perform independent backlight brightness regulation control to various color sub-pixels in each of the backlight subareas.

Figure 6:
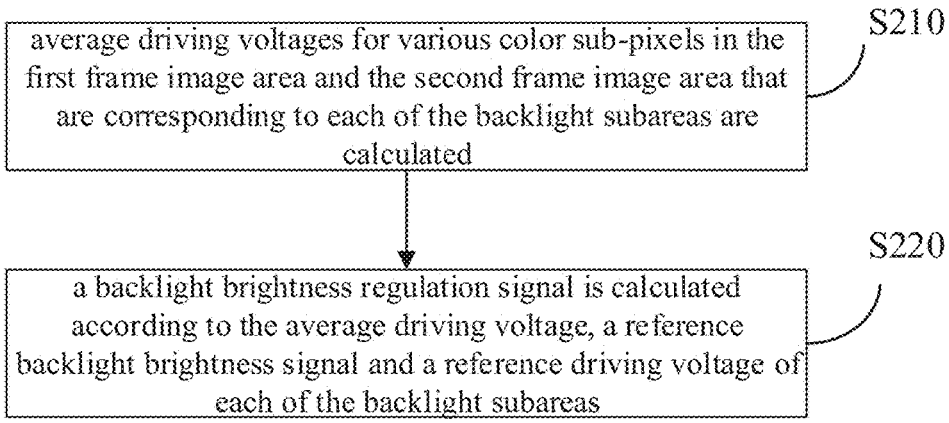
FIG. 6 is a specific flowchart of the step S120 in FIG. 1.

In the present embodiment, the process to determine the backlight brightness regulation signal is illustrated in FIG. 6, which includes step S210 and step S220.

Step S210, average driving voltages for various color sub-pixels in the first frame image area and the second frame image area that are corresponding to each of the backlight subareas are calculated.

The formula for calculating average driving voltages for various color sub-pixels in the first frame image area corresponding to each of the backlight subareas is as follows:

$$P_{M_ave1}=\mathrm{Ave}(P_{M_n_TL},P_{M_n+1_TH},P_{M_n+2_TL},\ldots),n=1,2,3\ldots$$

Therein, P is the target color subpixel, M is the serial number for the backlight subarea, ave1 is the average driving voltage value of the first frame image, and n is the serial number of P sub-pixel in backlight subarea M.

In particular, the average driving voltage for various color sub-pixels is calculated as:

$$R_{M_ave1}=\mathrm{Ave}(R_{M_n_TL},R_{M_n+1_TH},R_{M_n+2_TL},\ldots),\ n=1,2,3\ldots;$$

$$G_{M_ave1}=\mathrm{Ave}(G_{M_n_TH},G_{M_n+1_TL},G_{M_n+2_TH},\ldots),\ n=1,2,3\ldots;$$

$$B_{M_ave1}=\mathrm{Ave}(B_{M_n_TL},B_{M_n+1_TH},B_{M_n+2_TL},\ldots),\ n=1,2,3\ldots$$

In Step S220, a backlight brightness regulation signal is calculated according to the average driving voltage, a reference backlight brightness signal and a reference driving voltage of each of the backlight subareas.

The reference backlight brightness signal refers to a backlight brightness signal that is required when a high low voltage compensation is not performed (i.e., in conventional driving method). The reference driving voltage refers to the driving voltage for various sub-pixels when the high low voltage compensation is not performed. As backlight sources corresponding to various color sub-pixels in each subarea are controlled independently, the backlight brightness regulation signals of the backlight sources corresponding to various color sub-pixels in each subarea needs to be calculated. The formulas to calculate the backlight brightness regulation signal of each color sub-pixel in each of the backlight subareas M are:

$$A_{M_P1}*P_{M_ave1}=A_{M_P2}*P_{M_ave2};$$

$$2*A_{M_P}*P_{M_ave}=A_{M_P1}*P_{M_ave1}+A_{M_P2}*P_{M_ave2}.$$

Therein, P is the target color sub-pixel; M is the serial number of the backlight subarea. $A_{M_P1}$ is the backlight brightness regulation signal to perform the backlight brightness regulation to the backlight source of the P sub-pixel in the backlight subarea M corresponding to the first frame image of the next picture. $A_{M_P2}$ is the backlight brightness regulation signal to perform the backlight brightness regulation to the backlight source of the P sub-pixel in the backlight subarea M corresponding to the second frame image of the next picture. $P_{M_ave1}$ is the average value of the driving voltage of the P sub-pixel in the backlight subarea M corresponding to the first frame image of the next picture. In the present embodiment, as the driving voltage of sub-pixel is matched with the input signal (i.e., the gray scale of the corresponding color), thereby allowing the average value of the driving voltage to be an evaluating index of the viewing angle brightness of the color sub-pixel. $PM_{_ave2}$ is the average value of the driving voltage of the P sub-pixel in the backlight subarea M corresponding to the second frame image of the next picture. $A_{M_P}$ is the reference backlight brightness signal of the P sub-pixel in the backlight subarea M corresponding to the image of the current picture. $P_{M_ave}$ is the average value of the reference driving voltage of the P sub-pixel in the frame image region corresponding to the backlight subarea M on the image of the current picture. In particular, $P_{M_ave1}=\mathrm{Ave}(P_n+P_{n+1}+P_{n+2}+\ .\ .\ .\ )$, n=1, 2, 3 . . . .

In the present embodiment, each pixel in each of the frame images includes an R sub-pixel, a G sub-pixel and a B sub-pixel. Therefore, the backlight brightness regulation signals of backlight source for various color sub-pixel in each of the backlight subareas need to be calculated correspondingly, in particular:

The formulas to calculate the backlight brightness regulation signals $A_{M_R1}$ and $A_{M_R2}$ of R sub-pixels in the backlight subarea M are:

$$A_{M_R1}*R_{M_ave1}=A_{M_R2}*R_{M_ave2};$$

$$2*A_{M_R}*R_{M_ave}=A_{M_R1}*R_{M_ave1}+A_{M_R2}*R_{M_ave2};$$

The formulas to calculate the backlight brightness regulation signals $A_{M_G1}$ and $A_{M_G2}$ of R sub-pixels in the backlight subarea M are:

$$A_{M_G1}*G_{M_ave1}A_{M_G2}*G_{M_ave2};$$

$$2*A_{M_P}*G_{M_ave}=A_{M_G1}*G_{M_ave1}+A_{M_G2}*PG_{M_ave2};$$

The formulas to calculate the backlight brightness regulation signals $A_{M_B1}$ and $A_{M_B2}$ of R sub-pixels in the backlight subarea M are:

$$A_{M_B1}*B_{M_ave1}A_{M_B2}*B_{M_ave2};$$

$$2*A_{M_B}*B_{M_ave}=A_{M_B1}*B_{M_ave1}+A_{M_B2}*B_{M_ave2}.$$

Figure 7:
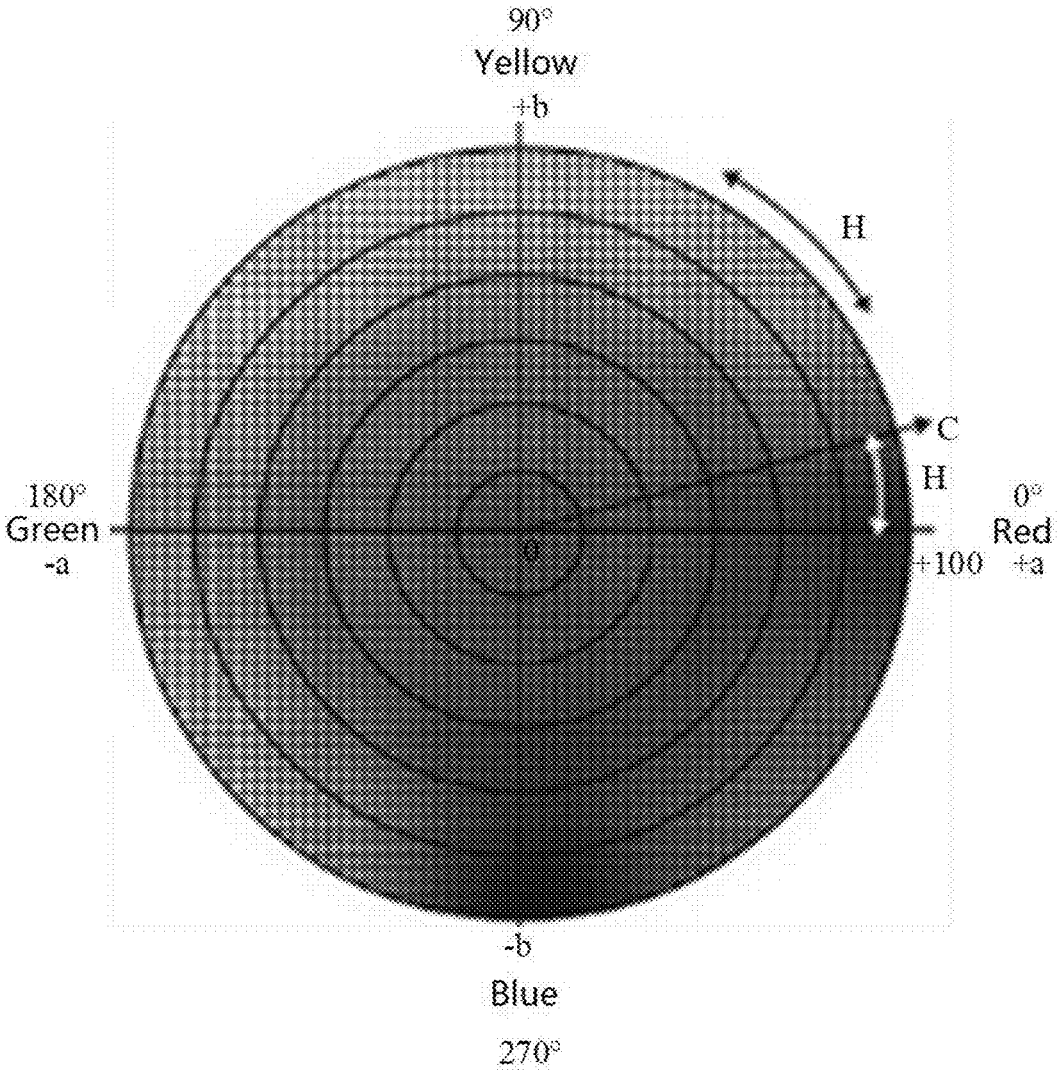
FIG. 7 is a schematic view of a CIE LCH color space system employed in Step S150.

In Step S130, an average color chroma of a current picture region corresponding to each of the backlight subareas is calculated;

The color chroma is calculated based on CIE LCH color space system and referring to each function of the color space coordinates of the CIE specification. In particular, L=f1(R, G, B), C=f2(R, G, B), H=f3(R, G, B), the above function relationship can be learned from CIE specification. CIE LCH color space system is shown in FIG. 7. FIG. 7 only shows the locations of the major and representative colors such as red, yellow, green and blue, without indications on the locations of other colors. As the CIE LCH color space system is a color space system known to a person of ordinary skill in the art, merely providing FIG. 7 should be sufficient for a person of ordinary skill in the art to understand the full situation of the CIE LCH color space system. In FIG. 7, L is the brightness, C is the color chroma, representing the bright degree of the color. C is ranged from 0 to 100, whereby at 100 is the brightest. The value of C is, to certain extent, representing the voltage signal when the LCD is being driven, therefore, the average color chroma of each picture can be obtained by calculating the average driving voltage.

In particular, as to the calculation of the average color chroma, the average driving voltage for each color sub-pixel in the current picture region corresponding to each of the backlight subareas should be calculated first. That is, performing a summation of the average driving voltages for various color sub-pixels in the first frame image area and the second frame image area that are corresponding to each of the backlight subareas and averaging the same. In the present embodiment, as the driving voltage for the second frame image is a reverse of the driving voltage of the first frame image, i.e., the average driving voltages of the two frame images are the same. As such, it is only needed to calculate the average driving voltage of one frame image to obtain the average driving voltage for such type of color sub-pixels of the current picture region corresponding to the backlight subarea, the calculation formula are as follows:

$$R_\mathrm{ave}=\mathrm{Ave}(R_{M_1}+R_{M_2}+\ .\ .\ .\ +R_{M_n});$$

$$G_\mathrm{ave}=\mathrm{Ave}(G_{M_1}+G_{M_2}+\ .\ .\ .\ +G_{M_n});$$

$$B_\mathrm{ave}=\mathrm{Ave}(B_{M_1}+B_{M_2}+\ .\ .\ .\ +B_{M_n}).$$

M is the serial number of the backlight subarea, n is the serial number of the sub-pixel among all such type of color sub-pixels in the backlight subarea M. As such, according to the function relation C=f2(R, G, B), the average color chroma C can be obtained by substituting the above result:

$$C=f2(R_\mathrm{ave},G_\mathrm{ave},B_\mathrm{ave}).$$

In Step S140, it is determined whether the average color chroma of each of the backlight subareas is within a preset range.

The preset range, i.e., CTL and CTH can be set as required. To determine whether the average color chroma satisfy:

$$C_{TL}\leq C\leq C_{TH}.$$

If the average color chroma C of the current backlight subarea satisfies the above conditions, a step S150 is executed to the backlight subarea, and a step S160 is otherwise executed if not. By a determination of the average color chroma, the blink notable to the eyes and caused by the frequent starting of backlight source regulation can be avoided.

In Step S150, a brightness regulation to a backlight source of the backlight subarea in each of the frame images of a next picture is performed according to the backlight brightness regulation signal of the backlight subarea.

In the present embodiment, independent backlight regulations can be performed to backlight sources of various color sub-pixels according to the generated plurality of groups of backlight brightness regulation signals. In the regulation, independent regulations are performed to the backlight sources of R sub-pixel, G sub-pixel and B sub-pixel in the backlight subarea M corresponding to the first frame image of the next picture according to $A_{M_R2}$, $A_{M_G2}$ and $A_{M_B2}$, and independent regulations are performed to the backlight sources of R sub-pixel, G sub-pixel and B sub-pixel in the backlight subarea M corresponding to the second frame image of the next picture according to $A_{M_R2}$, $A_{M_G2}$ and $A_{M_B2}$, such that the compensated image brightness is the same as that when no high low voltage compensation is performed (i.e., the traditional driving). Through an independent backlight source control, the uncomfortable blink notable to the eyes and caused by high and low voltage switching difference in the driving can be reduced, thereby effectively ameliorating the color shift deficiency of LCD in large viewing angle refractive rate mismatching.

Figure 8:
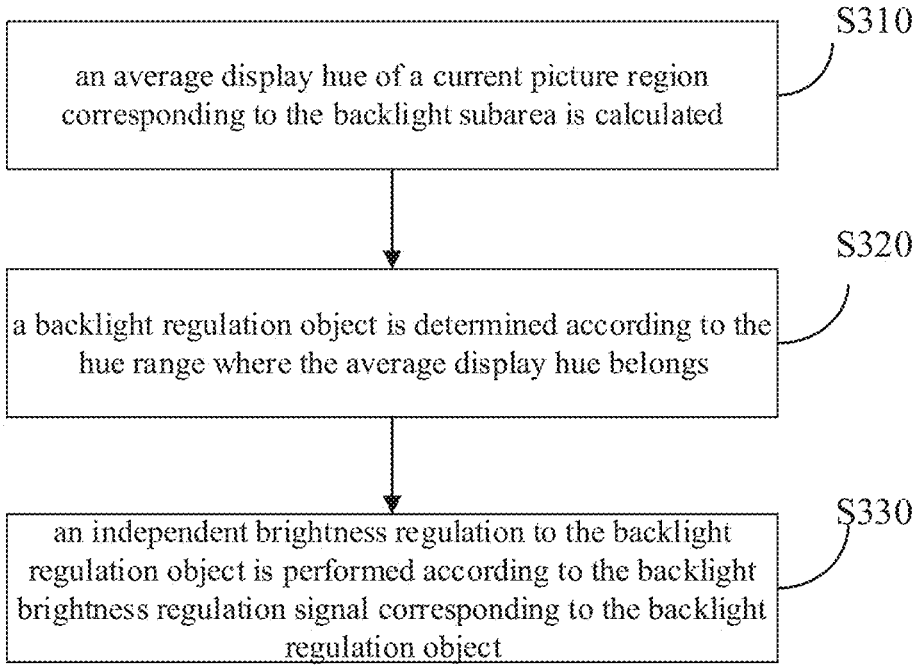
FIG. 8 is a specific flowchart of the step S120 in FIG. 1.

In the present embodiment, Step S150 includes the following sub-steps, as shown in FIG. 8.

Step S310, an average display hue of a current picture region corresponding to the backlight subarea is calculated.

Referring to FIG. 7, in the CIE LCH color space system, H is the display hue, that is the color representation. 0 to 360° is the color presentation of different hue, of which, it is defined that 0° is red, 90° is yellow, 180° is green and 270° is blue. The calculation of average display hue H is identical to the calculation of the average color chroma, both of which are to calculate the average driving voltages R_ave, G_ave and B_ave of such type of color sub-pixels in the current picture region corresponding to the backlight subarea and then obtained according to the function relation H=f3(R, G, B). In particular:

$$H=f3(R_\text{ave},G_\text{ave},B_\text{ave}).$$

In Step S320, a backlight regulation object is determined according to the hue range where the average display hue belongs.

The hue value is pre-divided into a plurality of spectrum. The dividing method can be set as required. In the present embodiment, the hue value is divided into 6 spectrums, each of which is corresponding to a respective backlight regulation object. In particular, when 0°<H≤45° or 315°<H≤360°, the object of the backlight regulation is the backlight source corresponding to the red sub-pixel; when 45°<H≤135°, the backlight regulation objects are the backlight sources respectively corresponding to the red sub-pixel and the green sub-pixel; when 135°<H≤205°, the backlight regulation object is the backlight source corresponding to the green sub-pixel; when 205°<H≤245°, the backlight regulation objects are the backlight sources respectively corresponding to the green sub-pixel and the blue sub-pixel; when 245°<H≤295°, the backlight regulation object is the backlight source corresponding to the blue sub-pixel; when 295°<H≤315°, the backlight regulation objects are the backlight sources respectively corresponding to the blue sub-pixel and the red sub-pixel.

In Step S330, an independent brightness regulation to the backlight regulation object is performed according to the backlight brightness regulation signal corresponding to the backlight regulation object.

In particular, when 0°<H≤45° or 315°<H≤360°, the backlight regulation object is the backlight source corresponding to the red sub-pixel, that is performing a backlight regulation to the red sub-pixel in the backlight subarea according to $A_{M_R1}$ and $A_{M_R2}$, and do not perform a regulation to the backlight brightness of other color sub-pixels. When 45°<H≤135°, the objects of the backlight regulation are the backlight sources respectively corresponding to the red sub-pixel and the green sub-pixel, that is performing independent backlight regulations to the red sub-pixel and blue sub-pixel according to $A_{M_R1}$ and $A_{M_R2}$, $A_{M_G1}$ and $A_{M_G2}$. The processes of other situations are omitted in brevity as they are similar to the above situations.

In Step S160, a backlight brightness regulation is not performed to the backlight subarea.

The above LCD driving method, by displaying each picture with two frame images sequentially, each of the frame images is driven by alternate high and low voltage signals, and the high and low driving voltages of the first frame image and second frame image are reverted, and the backlight brightness regulation signals of the next picture are generated in accordance to each driving voltage. In the meanwhile, average color chroma of the current picture region corresponding to each of the backlight subareas is calculated and a backlight regulation is merely performed to the backlight source in the backlight subarea corresponding to each of the frame images of the next picture when the average color chroma is determined to be within the preset range, such that the uncomfortable blink notable to the eyes and due to high and low driving voltage switch difference can be reduced, and the blink visible to the eyes and possibly caused by the frequent enabling of backlight source regulation can be avoided, thereby effectively ameliorating the color shift deficiency of the LCD in large view refractive rate mismatching.

The above driving method, aided with a compensation to the brightness of the backlight subarea M, not only can maintain the overall panel brightness to be the same with the brightness of the uncompensated conventional driving, but also can effect a low color shift viewing angle compensation and avoid the original uncomfortable blink notable to the eyes and caused by high and low voltage switching difference in the driving, thereby effectively ameliorating the color shift deficiency of LCD in large viewing angle refractive rate mismatching. The above driving method can effect a coordinated driving in timing and space. Also, by employing the method for driving above, the pixels of the LCD device are no longer needed to be divided into primary and secondary sub-pixels, thereby greatly reducing the process complexity and remarkably increasing the penetration rate and resolution of the LCD panel and reducing the cost of backlight design.

Figure 9:
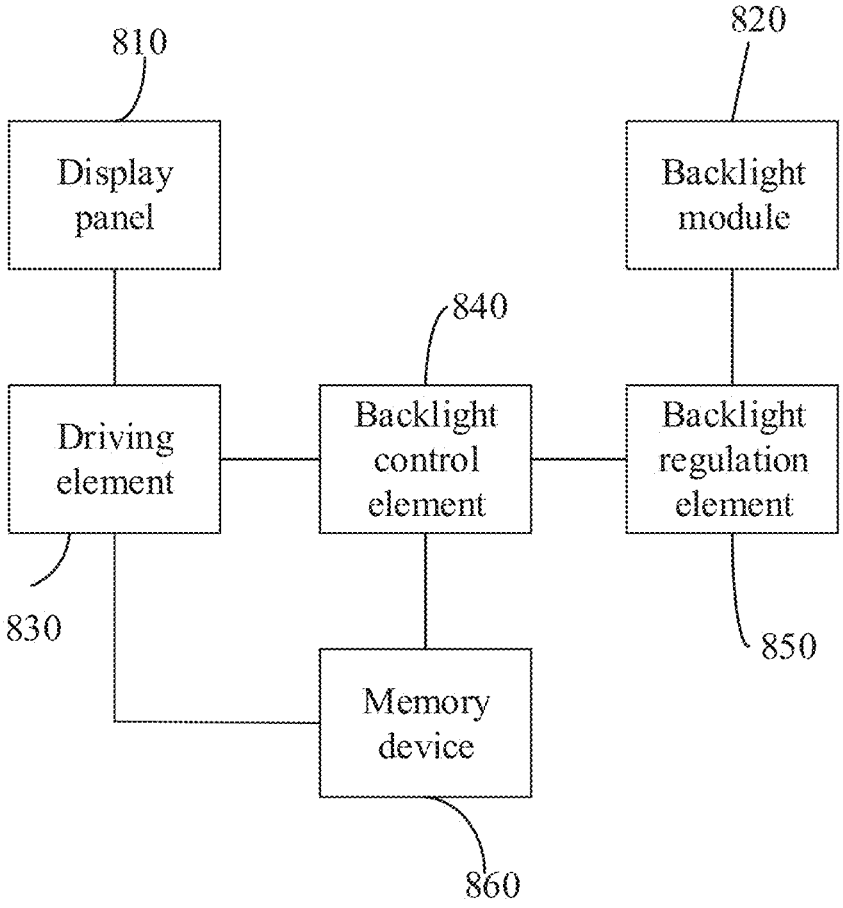
FIG. 9 is a block diagram of a structure of an LCD device according to an embodiment.

The present application also provides an LCD as illustrated in FIG. 9. The LCD can execute the above driving method. The LCD includes a display panel 810, a backlight module 820, a driving element 830, a backlight control element 840, and a backlight regulation element 850. The display panel 810 and the driving element 830 can be integrated on the display panel, while the backlight module 820, the backlight control element 840 and the backlight regulation element 850 can be integrated on the backlight module. It should be understood that the integrating of each elements is not limited thereto.

The display panel 810 can adopt TN, OCB, VA, thin film transistor (TFT) and color filter on array (COA) display panel, but not limited thereto. The display panel 810 can be a display panel with a curved panel.

The backlight module 820 is configured to provide backlight. The backlight module 820 may apply straight down backlight, the backlight source can be white, RGB three color light source, RGBW four color light source or RGBY four color light source, but not limited thereto. The backlight area of the backlight module is divided into a plurality of backlight subareas as illustrated in FIG. 2.

The driving element 830 is connected to the display panel 810. The driving element 830 is configured to display each picture with two frame images. The two frame images are respectively a first frame image and a second frame image. Through a mutual compensation between the first frame image and the second frame image, a picture corresponding to the input signal is displayed for a user. In the present embodiment, driving voltages for two adjacent sub-pixels in each of the frame images are different, and driving voltages for each of the sub-pixels in the first frame image and the second frame image are different; i.e., the driving voltage for each sub-pixel of the first frame image is reverted to be the driving voltage for each sub-pixel in the second frame image. The driving voltage of the driving element 830 driving each sub-pixel can be found and acquired utilizing the LUT. In particular, in the LCD device, the LUT will be pre-stored in the hardware frame buffer. The LUT is a correspondence table on the picture input signals and the driving voltages for each of the sub-pixels in the first frame image and the second frame image that are corresponding to the input signals. The driving element 830 includes a timing controller (TCON) circuit. In an embodiment, the LCD further includes a memory device 860 configured to store the LUT.

The backlight control part 840 is connected to the driving element 830. The backlight control element 840 is configured to determine the backlight brightness regulation signals for each of the backlight subareas according to driving voltages of a first frame image area and a second frame image area that are corresponding to each of the backlight subareas. In one embodiment, the backlight compensation control part 840 includes a memory and one or more processors. The memory has stored computer-readable instructions that can be executed by the one or more processors. The computer-readable instructions are executed by one or more processors to perform operations of determining the backlight brightness regulation signals for each of the backlight subareas according to the driving voltages of a first frame image area and a second frame image area that are corresponding to each of the backlight subareas. The backlight brightness regulation signals are grouped signals ($A_{M_P1}$ and $A_{M_P2}$, P is the target color sub-pixel) to respectively regulate the backlight brightness of the backlight subareas corresponding to the first frame image and the second frame image, and the groups of backlight brightness regulation signals and the types of color sub-pixels are identical in number, so as to perform an independent backlight brightness control to various color sub-pixels. For instance, in the present embodiment, color sub-pixels include red sub-pixels (R sub-pixels), green sub-pixels (G sub-pixels) and blue sub-pixels (B sub-pixels), therefore each group of backlight brightness regulation signals includes an R sub-pixel backlight brightness regulation signal group, a G sub-pixel backlight brightness regulation signal group, and a B sub-pixel backlight brightness regulation signal group to perform independent backlight brightness regulation control to various color sub-pixels in each of the backlight subareas.

Figure 10:
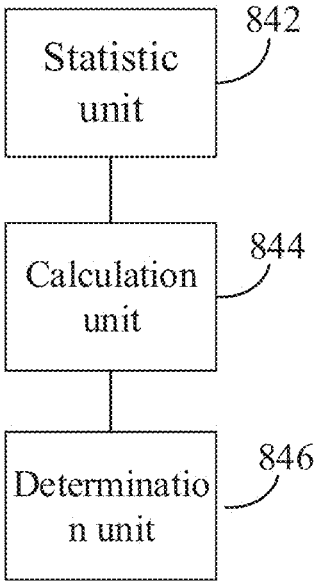
FIG. 10 is a block diagram of a structure of a backlight control element according to an embodiment.

Furthermore, when the computer executable instructions stored in the memory device of the backlight control element 840 are to be executed by the one or more processors, the one or more processors will be caused to perform operations in the following units, as illustrated in FIG. 10. The formula the statistic unit 842 is configured with to calculate the average driving voltages for various color sub-pixels in the first frame image area corresponding to each of the backlight subareas is as follows:

$$PM_{_ave1}=(P_{M_n_TL},P_{M_n+1_TH},P_{M_n+2_TL},\ldots),n=1,2,3\ldots$$

Therein, P is the target color subpixel, M is the serial number for the backlight subarea, ave1 is the average driving voltage value of the first frame image, and n is the serial number of P sub-pixel in backlight subarea M.

In particular, the average driving voltage for various color sub-pixels is calculated as:

$$R_{M_ave1}=\mathrm{Ave}(R_{M_n_TL},R_{M_n+1_TH},R_{M_n+2_TL},\ldots),n=1,2,3\ldots$$

$$G_{M_ave1}=\mathrm{Ave}(G_{M_n_TH},G_{M_n+1_TL},G_{M_n+2_TH},\ldots),n=1,2,3\ldots$$

$$B_{M_ave1}=\mathrm{Ave}(B_{M_n_TL},B_{M_n+1_TH},B_{M_n+2_TL},\ldots),n=1,2,3\ldots$$

The calculation unit 844 is configured to calculate a backlight brightness regulation signal according to the average driving voltage, a reference backlight brightness signal and a reference driving voltage of each of the backlight subareas. The reference backlight brightness signal refers to a backlight brightness signal that is required when a high low voltage compensation is not performed (i.e., in conventional driving method). The reference driving voltage refers to the driving voltage for various sub-pixels when the high low voltage compensation is not performed. As backlight sources corresponding to various color sub-pixels in each subarea are controlled independently, the backlight brightness regulation signals of the backlight sources corresponding to various color sub-pixels in each subarea need to be calculated. The formulas to calculate the backlight brightness regulation signal of each color sub-pixel in each of the backlight subareas M are:

$$A_{M_P1}*P_{M_ave1}=A_{M_P2}*P_{M_ave2};$$

$$2*A_{M_P}*P_{M_ave}=A_{M_P1}*P_{M_ave1}+A_{M_P2}*P_{M_ave2}.$$

Therein, P is the target color sub-pixel; M is the serial number of the backlight subarea. $A_{M_P1}$ is the backlight brightness regulation signal to perform the backlight brightness regulation to the backlight source of the P sub-pixel in the backlight subarea M corresponding to the first frame image of the next picture. $A_{M_P2}$ is the backlight brightness regulation signal to perform the backlight brightness regulation to the backlight source of the P sub-pixel in the backlight subarea M corresponding to the second frame image of the next picture. $P_{M_ave1}$ is the average value of the driving voltage of the P sub-pixel in the backlight subarea M corresponding to the first frame image of the next picture. In the present embodiment, as the driving voltage of sub-pixel is matched with the input signal (i.e., the gray scale of the corresponding color), thereby allowing the average value of the driving voltage to be an evaluating index of the viewing angle brightness of the color sub-pixel. $P_{M_ave2}$ is the average value of the driving voltage of the P sub-pixel in the backlight subarea M corresponding to the second frame image of the next picture. $A_{M_P}$ is the reference backlight brightness signal of the P sub-pixel in the backlight subarea M corresponding to the image of the current picture. $P_{M_ave}$ is the average value of the reference driving voltage of the P sub-pixel in the frame image region corresponding to the backlight subarea M on the image of the current picture. In particular, $P_{M_ave1}=Ave(P_n+P_{n+1}+P_{n+2}+\ .\ .\ .\ .)$, n=1, 2, 3 . . . .

Furthermore, when the computer-executable instructions stored in the memory device are to be executed by the one or more processors, the one or more processors execute the instructions to perform the steps in the determination unit 846. In the present embodiment, the calculation unit 844 is configured to calculate the average color chroma of a current picture region corresponding to each of the backlight subareas. The determination unit 846 is configured to determine whether the average color chroma of each of the backlight subareas is within the preset range, and merely control the backlight regulation element 850 to perform a brightness regulation to the backlight source of the backlight subarea in each of the frame images of the next picture according to the backlight brightness regulation signal of the backlight subarea when it is determined that the average color chroma of each of the backlight subareas is within the preset range and otherwise do not control the backlight regulation element 850 to perform a backlight brightness regulation to the backlight subarea. In an embodiment, the backlight regulation element 850 performs independent brightness regulations to the backlight sources of various color sub-pixels in the backlight subarea corresponding to each of the frame images of the next picture according to the backlight brightness regulation signal of each of the backlight subareas, such that the compensated image brightness is the same with the image brightness that is not being high and low voltage compensated.

In the present embodiment, the backlight control element 840 is also configured, when it is determined that the backlight subarea needs a backlight brightness compensation, to first calculate the average display hue of the current picture region corresponding to the backlight subarea through the calculation unit 844 and then determine the object of the backlight regulation according to such average display hue. The backlight regulation object includes a backlight source including at least one of a red sub-pixel, a green sub-pixel and a blue sub-pixel. The backlight regulation element 850 performs an independent brightness regulation to the backlight regulation object according to the backlight regulation signal corresponding to the backlight regulation object, such that the uncomfortable blink notable to the eyes and due to high and low driving voltage switch difference can be reduced, and the blink visible to the eyes and possibly caused by the frequent enabling of backlight source regulation can be avoided, thereby effectively ameliorating the color shift deficiency of the LCD in large view refractive rate mismatching.

The above LCD, by displaying each picture with two frame images sequentially, each of the frame images is driven by alternate high and low voltage signals, and the high and low driving voltages of the first frame image and second frame image are reverted, and the backlight brightness regulation signals of the next picture are generated in accordance to each driving voltage. In the meanwhile, average color chroma of the current picture region corresponding to each of the backlight subareas is calculated and an independent backlight regulation is merely performed to the backlight source of various color sub-pixels in the backlight subarea corresponding to each of the frame images of the next picture when the average color chroma is determined to be within the preset range, such that the uncomfortable blink notable to the eyes and due to high and low driving voltage switch difference can be reduced, and the blink visible to the eyes and possibly caused by the frequent enabling of backlight source regulation can be avoided, thereby effectively ameliorating the color shift deficiency of the LCD in large view refractive rate mismatching.

The above LCD, aided with a compensation to the brightness of each of the backlight subareas M, not only can maintain the overall panel brightness to be the same with the brightness of the uncompensated conventional driving, but also can effect a low color shift viewing angle compensation and avoid the original uncomfortable blink notable to the eyes and caused by high and low voltage switching difference in the driving, thereby effectively ameliorating the color shift deficiency of LCD in large viewing angle refractive rate mismatching. The above LCD can effect a coordinated driving in timing and space. Also, by employing the LCD above, the pixels of the LCD device are no longer needed to be divided into primary and secondary sub-pixels, thereby greatly reducing the process complexity and remarkably increasing the penetration rate and resolution of the LCD panel and reducing the cost of backlight design.

A person skilled in the art should understand the processes of the methods in the above embodiments can be, in full or in part, implemented by computer programs instructing underlying hardware, the programs can be stored in a computer-readable storage medium, the program can include the processes in the embodiments of the various methods when it is being executed. The storage medium can be a disk, a CD, a Read-Only Memory (ROM) and other non-volatile storage mediums or Random Access Memory (RAM) and so on.

The different technical features of the above embodiments can have various combinations which are not described for the purpose of brevity. Nevertheless, to the extent the combining of the different technical features does not conflict with each other, all such combinations must be regarded as within the scope of the disclosure.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A method for driving a liquid crystal display (LCD) device comprising:

displaying each picture with two frame images sequentially; wherein the two frame images comprise a first frame image and a second frame image; driving voltages for two adjacent sub-pixels in each of the frame images are different, and the driving voltages for each of the sub-pixels in the first frame image and the second frame image are different;

determining backlight brightness regulation signals for each of backlight subareas according to the driving voltages of a first frame image area and a second frame image area, wherein the first frame image area and the second frame image area are corresponding to each of the backlight subareas; the backlight brightness regulation signals are grouped signals, the number of the groups is identical to the number of types of color sub-pixels;

calculating an average color chroma of a current picture region corresponding to each of the backlight subareas;

determining whether the average color chroma of each of the backlight subareas is within a preset range; and if the average color chroma of each of the backlight subareas is within a preset range, performing a brightness regulation to a backlight source of the backlight subarea in each of the frame images of a next picture according to the backlight brightness regulation signal of the backlight subarea.

2. The method according to claim 1, wherein the driving voltages for each of the sub-pixels in the first frame image and the second frame image are found and acquired utilizing a Look-up table (LUT) according to an input signal of the picture.

3. The method according to claim 2, further comprising a step of pre-storing the LUT.

4. The method according to claim 1, wherein the step of determining backlight brightness regulation signals for each of the backlight subareas according to the driving voltages of the first frame image area and the second frame image area comprises:

calculating average driving voltages for various color sub-pixels in the first frame image area and the second frame image area, wherein the first frame image area and the second frame image area are corresponding to each of the backlight subareas; and calculating the backlight brightness regulation signal according to the average driving voltage, a reference backlight brightness signal and a reference driving voltage.

5. The method according to claim 4, wherein in the step of calculating the backlight brightness regulation signal according to the average driving voltage, the reference backlight brightness signal and the reference driving voltage, the formulas to calculate the backlight brightness regulation signal of each color sub-pixel in each of the backlight subareas are:

$$A_{M_P1}*P_{M_ave1}=A_{M_P2}*P_{M_ave2};$$

$$2*A_{M_P}*P_{M_ave}=A_{M_P1}*P_{M_ave1}+A_{M_P2}*P_{M_ave2};$$

wherein P is a target color sub-pixel; M is a serial number of the backlight subarea, $A_{M_P1}$ is the backlight brightness regulation signal to perform the backlight brightness regulation to the backlight source of a P sub-pixel in a backlight subarea M corresponding to the first frame image of the next picture; $A_{M_P2}$ is the backlight brightness regulation signal to perform a backlight brightness regulation to the backlight source of the P sub-pixel in the backlight subarea M corresponding to the second frame image of the next picture; $P_{M_ave1}$ is an average value of the driving voltage of the P sub-pixel in the backlight subarea M corresponding to the first frame image of the current picture; $P_{M_ave2}$ is an average value of the driving voltage of the P sub-pixel in the backlight subarea M corresponding to the second frame image of the current picture; $A_{M_P}$ is the reference backlight brightness signal of the P sub-pixel in the backlight subarea M corresponding to the image of the current picture; $P_{M_ave}$ is the average value of the reference driving voltage of the P sub-pixel in the frame image area corresponding to the backlight subarea M on the image of the current picture.

6. The method according to claim 1, wherein in the step of determining whether the average color chroma of each of the backlight subareas is within the preset range, if the average color chroma is not within the preset range, a brightness regulation will not be performed to the backlight source of the backlight subarea.

7. The method according to claim 1, wherein the step of performing the brightness regulation to the backlight source of the backlight subarea in each of the frame images of the next picture according to the backlight brightness regulation signal of the backlight subarea comprises:

calculating an average display hue of a current picture region corresponding to the backlight subarea;

determining a backlight regulation object according to the hue range where the average display hue belongs; wherein the backlight regulation object comprises a backlight source of at least one of a red sub-pixel, a green sub-pixel and a blue sub-pixel; and performing an independent brightness regulation to the backlight regulation object according to the backlight brightness regulation signal corresponding to the backlight regulation object.

8. The method according to claim 7, wherein in the step of determining a backlight regulation object according to the hue range where the average display hue belongs, when the average display hue is $0°<H\leq 45°$ or $315°<H\leq 360°$, the object of the backlight regulation is the backlight source corresponding to the red sub-pixel;

when the average display hue is $45°<H\leq 135°$, the object of the backlight regulation are the backlight sources respectively corresponding to the red sub-pixel and the green sub-pixel;

when the average display hue is $135°<H\leq 205°$, the object of the backlight regulation is the backlight source corresponding to the green sub-pixel;

when the average display hue is $205°<H\leq 245°$, the object of the backlight regulation are the backlight sources respectively corresponding to the green sub-pixel and the blue sub-pixel;

when the average display hue is $245°<H\leq 295°$, the object of the backlight regulation is the backlight source corresponding to the blue sub-pixel; and when the average display hue is $295°<H\leq 315°$, the object of the backlight regulation are the backlight sources respectively corresponding to the blue sub-pixel and the red sub-pixel; wherein H is the average display hue.

9. An LCD device, comprising:

a display panel;

a backlight module configured to provide backlight to the display panel; wherein the backlight module is divided into a plurality of backlight subareas;

a driving element connected to the display panel and configured to display each picture with two frame images sequentially; wherein the two frame images comprise a first frame image and a second frame image; driving voltages for two adjacent sub-pixels in each of the frame images are different, and driving voltages for each of the sub-pixels in the first frame image and the second frame image are different;

a backlight control element connected to the driving element and comprising one or more processors, and memory storing instructions, which, when executed by the one or more processors cause the one or more processors to perform operations comprising:

determining backlight brightness regulation signals for each of the backlight subareas according to the driving voltages of a first frame image area and a second frame image area, wherein the first frame image area and the second frame image area are corresponding to each of the backlight subareas; wherein the backlight brightness regulation signals are grouped signals, the number of the groups is identical to the number of types of the color sub-pixels; and calculating an average color chroma of a current picture region corresponding to each of the backlight subareas, and determining whether the average color chroma of each of the backlight subareas is within a preset range; and;

wherein a brightness regulation is performed to a backlight source of the backlight subarea in each of the frame images of a next picture according to the backlight brightness regulation signal of the backlight subarea when the average color chroma of the backlight subarea is determined by the backlight control element to be in the preset range.

10. The LCD device according to claim 9, further comprising a storage element configured to store an LUT; wherein the LUT is a correspondence table on input signals and the driving voltages for each of the sub-pixels in the first frame image and the second frame image, wherein the first frame image area and the second frame image area are corresponding to the input signals in a stored LUT including the input signals and the driving voltages for each of the sub-pixels in the first frame image and the second frame image; the driving element acquires the driving voltages for each of the sub-pixels of the first frame image and the second frame image by looking up in the LUT.

11. The LCD device according to claim 9, wherein the one or more processors further execute the instructions to perform operations comprising:

calculating average driving voltages for various color sub-pixels in the first frame image area and the second frame image area, wherein the first frame image area and the second frame image area are corresponding to each of the backlight subareas; and calculating the backlight brightness regulation signal according to the average driving voltage, a reference backlight brightness signal and a reference driving voltage of each of the backlight subareas.

12. The LCD device according to claim 11, wherein the formulas to calculate the backlight brightness regulation signal of each of the color sub-pixels in each of the backlight subareas are:

$$A_{M_P1}*P_{M_ave1}=A_{M_P2}*P_{M_ave2};$$

$$2*A_{M_P}*P_{M_ave}=A_{M_P1}*P_{M_ave1}+A_{M_P2}*P_{M_ave2};$$

wherein P is a target color sub-pixel; M is a serial number of the backlight area, $A_{M_P1}$ is a backlight brightness regulation signal to perform a backlight brightness regulation to a backlight source of a P sub-pixel in a backlight area M corresponding to the first frame image of the next picture; $A_{M_P2}$ is a backlight brightness regulation signal to perform a backlight brightness regulation to a backlight source of the P sub-pixel in the backlight area M corresponding to the second frame image of the next picture; $P_{M_ave1}$ is an average value of a driving voltage of the P sub-pixel in the backlight area M corresponding to the first frame image of the current picture; $P_{M_ave2}$ is an average value of the driving voltage of the P sub-pixel in the backlight area M corresponding to the second frame image of the current picture; $A_{M_P}$ is a reference backlight brightness signal of the P sub-pixel in the backlight area M corresponding to the image of the current picture; $P_{M_ave}$ is an average value of a reference driving voltage of the P sub-pixel in the frame image area corresponding to the backlight area M on the image of the current picture.

13. The LCD device according to claim 9, wherein the one or more processors further execute the instructions to provide a step of not performing a backlight regulation to the backlight source in the backlight subarea when the average color chroma of the backlight subarea is determined by the one or more processors to be out of the preset range.

14. The LCD device according to claim 9, wherein the one or more processors further execute the instructions to provide a step of calculating the average display hue of the current picture region corresponding to the backlight and determining a backlight regulation object according to the range where the average display hue belongs when the average color chroma is determined by the at least processor to be within the preset range; wherein the backlight regulation object comprises a backlight source of at least one of a red sub-pixel, a green sub-pixel and a blue sub-pixel;

wherein an independent brightness regulation is performed to the backlight regulation object according to the backlight regulation signal corresponding to the backlight regulation object.

15. The LCD device according to claim 14, wherein the one or more processors further execute the instructions to provide steps of:

determining the object of the backlight regulation to be the backlight source corresponding to the red sub-pixel when the average display hue is $0°<H\leq 45°$ or $315°<H\leq 360°$;

determining the object of the backlight regulation to be the backlight sources respectively corresponding to the red sub-pixel and the green sub-pixel when the average display hue is $45°<H\leq 135°$;

determining the object of the backlight regulation to be the backlight source corresponding to the green sub-pixel when the average display hue is $135°<H\leq 205°$;

determining the object of the backlight regulation to be the backlight sources respectively corresponding to the green sub-pixel and the blue sub-pixel when the average display hue is $205°<H\leq 245°$;

determining the object of the backlight regulation to be the backlight source corresponding to the blue sub-pixel when the average display hue is $245°<H\leq 295°$; and determining the object of the backlight regulation to be the backlight sources respectively corresponding to the blue sub-pixel and the red sub-pixel when the average display hue is $295°<H\leq 315°$; wherein H is the average display hue.

16. The LCD device according to claim 9, wherein the backlight source is a white backlight source, an RGB backlight source, an RGBW backlight source or an RGBY backlight source.

17. An LCD device, comprising:

a display panel;

a backlight module configured to provide backlight to the display panel; wherein the backlight module is divided into a plurality of backlight subareas;

a driving element connected to the display panel and configured to display each picture with two frame images sequentially; wherein the two frame images comprise a first frame image and a second frame image; driving voltages for two adjacent sub-pixels in each of the frame images are different, and driving voltages for each of the sub-pixels in the first frame image and the second frame image are different;

a backlight control element connected to the driving element, comprising one or more processors and memory storing instructions, which, when executed by the one or more processors cause the one or more processors to perform operations comprising:

determining backlight brightness regulation signals for each of the backlight subareas according to the driving voltages of a first frame image area and a second frame image area, wherein the first frame image area and the second frame image area are corresponding to each of the backlight subareas; wherein the backlight brightness regulation signals are grouped signals, the number of the groups is identical to the number of types of the color sub-pixels; and calculating an average color chroma of a current picture region corresponding to each of the backlight subareas, and determining whether the average color chroma of each of the backlight subareas is within a preset range;

wherein a brightness regulation is performed to a backlight source of the backlight subarea in each of the frame images of a next picture according to the backlight brightness regulation signal of the backlight subarea when the average color chroma of the backlight subarea is determined by the backlight control element to be in the preset range;

wherein the one or more processors further execute the instructions to perform operations comprising:

calculating average driving voltages for various color sub-pixels in the first frame image area and the second frame image area, wherein the first frame image area and the second frame image area are corresponding to each of the backlight subareas; and calculating the backlight brightness regulation signal according to the average driving voltage, a reference backlight brightness signal and a reference driving voltage of each of the backlight subareas, the calculation formulas are as follows:

$$A_{M_P1}*P_{M_ave1}=A_{M_P2}*P_{M_ave2};$$

$$2*A_{M_P}*P_{M_ave}=A_{M_P1}*P_{M_ave1}+A_{M_P2}*P_{M_ave2};$$

wherein P is a target color sub-pixel; M is a serial number of the backlight subarea, $A_{m_P1}$ is the backlight brightness regulation signal to perform a backlight brightness regulation to a backlight source of a P sub-pixel in a backlight subarea M corresponding to the first frame image of the next picture; $A_{m_P2}$ is the backlight brightness regulation signal to perform a backlight brightness regulation to a backlight source of the P sub-pixel in the backlight subarea M corresponding to the second frame image of the next picture; $P_{m_ave1}$ is an average value of a driving voltage of the P sub-pixel in the backlight subarea M corresponding to the first frame image of the current picture; $P_{m_ave2}$ is an average value of the driving voltage of the P sub-pixel in the backlight subarea M corresponding to the second frame image of the current picture; $A_{M_P}$ is a reference backlight brightness signal of the P sub-pixel in the backlight subarea M corresponding to the image of the current picture; $P_{M_ave}$ is an average value of a reference driving voltage of the P sub-pixel in the frame image area corresponding to the backlight subarea M on the image of the current picture.

18. The LCD device according to claim 17, wherein the one or more processors further execute the instructions to provide a step of calculating the average display hue of the current picture region corresponding to the backlight and determining a backlight regulation object according to the range where the average display hue belongs when the average color chroma is determined by the at least processor to be within the preset range; wherein the backlight regulation object comprises a backlight source of at least one of a red sub-pixel, a green sub-pixel and a blue sub-pixel;

wherein an independent brightness regulation is performed to the backlight regulation object according to the backlight regulation signal corresponding to the backlight regulation object.

* * * * *